US010984948B2

(12) United States Patent
Kothandaraman et al.

(10) Patent No.: US 10,984,948 B2
(45) Date of Patent: Apr. 20, 2021

(54) METHOD OF MANUFACTURING INDUCTORS IN BEOL WITH PARTICULATE MAGNETIC CORES

(71) Applicant: INTERNATIONAL BUSINESS MACHINES CORPORATION, Armonk, NY (US)

(72) Inventors: Chandrasekharan Kothandaraman, New York, NY (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/801,926

(22) Filed: Nov. 2, 2017

(65) Prior Publication Data

US 2018/0218824 A1 Aug. 2, 2018

Related U.S. Application Data

(63) Continuation of application No. 15/418,815, filed on Jan. 30, 2017, now Pat. No. 10,741,327.

(51) Int. Cl.
*H01F 41/04* (2006.01)
*H01F 41/02* (2006.01)
(Continued)

(52) U.S. Cl.
CPC ..... *H01F 41/041* (2013.01); *H01F 5/00* (2013.01); *H01F 27/02* (2013.01); *H01F 27/29* (2013.01);
(Continued)

(58) Field of Classification Search
CPC .. H01F 41/0206; H01F 41/041; H01F 41/046; H01F 27/255; H01F 27/2804;
(Continued)

(56) References Cited

U.S. PATENT DOCUMENTS 4,820,338 A * 4/1989 Ochiai ..... H01F 1/09 252/62.54
5,145,614 A * 9/1992 Kuroda ..... H01F 41/028 148/101
(Continued)

FOREIGN PATENT DOCUMENTS

CN 105185906 A 12/2015
CN 105185907 A 12/2015
(Continued)

OTHER PUBLICATIONS

Wang, N. et al., "Integrated on-chip inductors with electroplated magnetic yokes (invited)" Journal of Applied Physics (Mar. 2012) pp. 07E732-1-07E732-6, vol. 111.
List of IBM Patents or Patent Applications Treated as Related dated Nov. 2, 2017, 2 pages.

*Primary Examiner* — A. Dexter Tugbang
(74) *Attorney, Agent, or Firm* — Tutunjian & Bitetto, P.C.; Daniel Morris

(57) ABSTRACT

A method for forming an inductor device. The method comprises forming a trench within a central core region of a conductive coil formed within a dielectric material. The method further comprises forming a composite region within the trench. The composite region including a polymer matrix having a plurality of particles with magnetic properties dispersed therein with the central core region to reduce eddy current loss and increase energy storage.

20 Claims, 5 Drawing Sheets

(51) Int. Cl.

| | |
|---|---|
| ***H01F 27/32*** | (2006.01) |
| ***H01F 5/00*** | (2006.01) |
| ***H01F 27/29*** | (2006.01) |
| ***H01F 27/02*** | (2006.01) |
| *H01F 27/34* | (2006.01) |
| *H01F 27/255* | (2006.01) |
| *H01F 27/28* | (2006.01) |
| *H01F 3/08* | (2006.01) |
| *H01F 1/00* | (2006.01) |
| *H01F 1/09* | (2006.01) |

(52) U.S. Cl.
CPC ..... *H01F 41/0206* (2013.01); *H01F 41/028* (2013.01); *H01F 41/042* (2013.01); *H01F 1/0054* (2013.01); *H01F 1/09* (2013.01); *H01F 3/08* (2013.01); *H01F 27/255* (2013.01); *H01F 27/2804* (2013.01); *H01F 27/327* (2013.01); *H01F 27/34* (2013.01); *H01F 2027/2809* (2013.01); *H01F 2027/348* (2013.01); *Y10T 29/4902* (2015.01); *Y10T 29/4906* (2015.01); *Y10T 29/49073* (2015.01); *Y10T 29/49075* (2015.01)

(58) Field of Classification Search
CPC ..... H01F 27/29; H01F 27/327; H01F 27/34; H01F 2027/2809; H01F 2027/348; H01F 1/0054; H01F 1/09; H01F 41/042; H01F 41/028; H01F 3/08; H01F 5/00; H01F 27/02; Y10T 29/4902; Y10T 29/4906; Y10T 29/49073; Y10T 29/49075
See application file for complete search history.

(56) References Cited

U.S. PATENT DOCUMENTS

| | | | | |
|---|---|---|---|---|
| 5,312,674 | A | 5/1994 | Haertling et al. | |
| 5,532,667 | A | 7/1996 | Haertling et al. | |
| 7,271,693 | B2 | 9/2007 | Ding et al. | |
| 7,288,417 | B2 | 10/2007 | Ding et al. | |
| 7,531,824 | B1 | 5/2009 | Johnson et al. | |
| 7,723,819 | B2 | 5/2010 | Park | |
| 8,709,831 | B2 | 4/2014 | Hofmann et al. | |
| 8,907,447 | B2 | 12/2014 | Wang et al. | |
| 8,975,612 | B2 | 3/2015 | Hofmann et al. | |
| 2005/0285073 | A1* | 12/2005 | Singh | H01F 1/0054 252/62.54 |
| 2007/0159285 | A1* | 7/2007 | Renaud | H01F 41/042 336/200 |
| 2007/0256759 | A1* | 11/2007 | Matsukawa | H01F 27/255 148/101 |
| 2011/0227689 | A1* | 9/2011 | Chang | Y10T 29/4902 336/200 |
| 2013/0009740 | A1* | 1/2013 | Chang | Y10T 29/4902 336/200 |
| 2014/0104288 | A1* | 4/2014 | Shenoy | H01F 41/046 345/531 |
| 2015/0364235 | A1* | 12/2015 | Okamoto | H01F 3/08 336/221 |

FOREIGN PATENT DOCUMENTS

| | | | |
|---|---|---|---|
| CN | 205069321 | U | 3/2016 |
| JP | 03246907 | A * | 11/1991 |
| WO | 2016/065218 | A1 | 4/2016 |

* cited by examiner

METHOD OF MANUFACTURING INDUCTORS IN BEOL WITH PARTICULATE MAGNETIC CORES

BACKGROUND

Technical Field

The present invention generally relates to inductive devices, and more particularly to inductive devices and methods for fabrication that include magnetic cores with magnetic particles.

Description of the Related Art

Inductor formation is often challenging in semiconductor fabrication. Inductors are usually formed with copper wires for radiofrequency applications and DC-DC power converter applications. Typically, air-core inductors are standard in the industry but have low values for energy storage. Also, on-chip power converters require a good Q-factor at high frequencies. Electroplated NiFe inductors have also been employed; however, these types of inductors suffer from loss due to eddy currents. While laminated structures and patterns can reduce the eddy current, current/charge confinement is limited by the patterning.

SUMMARY

In accordance with embodiments of the present invention, an inductor device includes a conductive coil formed within a dielectric material and having a central core area within the coil. Particles are dispersed within the central core region to reduce eddy current loss and increase energy storage. The particles include magnetic properties.

Another inductor device includes a substrate and a plurality of layers formed on the substrate. A conductive coil is formed within the plurality of layers and has a central core area within the coil. A trench is formed within the central core region. A screen-printed composite material includes a plurality of particles dispersed within a polymer matrix within the trench in the central core region to reduce eddy current loss and increase energy storage.

A method for forming an inductor device includes forming a trench within a central core region of a conductive coil formed within a dielectric material; and forming a composite region within the trench, the composite region including a polymer matrix having a plurality of particles with magnetic properties dispersed therein with the central core region to reduce eddy current loss and increase energy storage.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Figure 1:
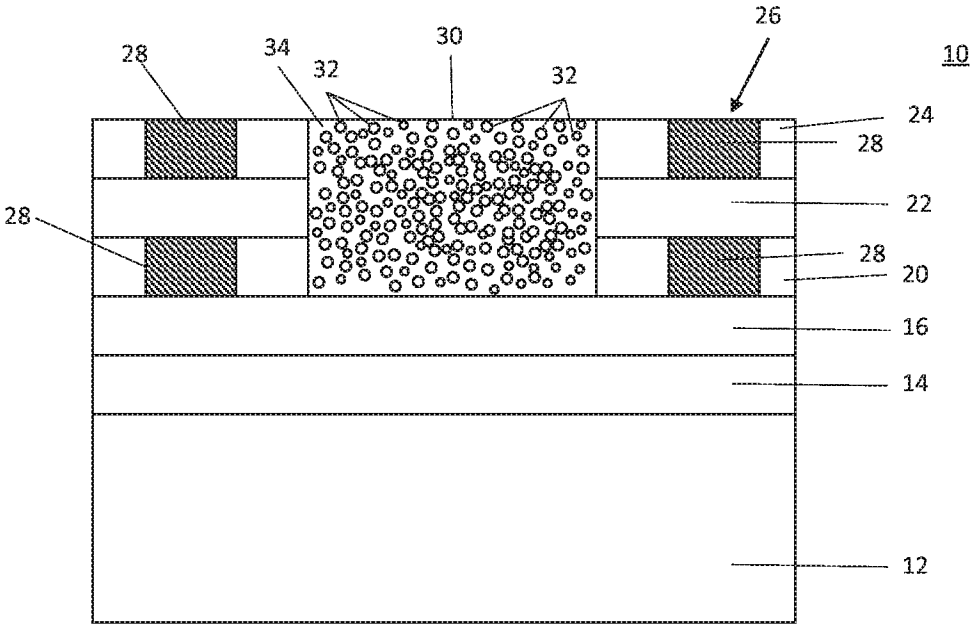
FIG. 1 is a cross-sectional view showing an inductor device having a particulate core in accordance with an embodiment of the present invention.

In accordance with aspects of the present invention, inductor devices are formed having a core formed using magnetic particles. After patterning the inductor device, which can be during, e.g., back end of the line (BEOL) processing, a deep trench is formed at a core of the inductor device. The core is filled with a matrix material having magnetic particles dispersed therein. Instead of sputtering, electroplating, etc. a solid magnet in the core, which leads to eddy current, a screen printing process can be employed to print fine particles of Co, Ni, Fe or alloys thereof covered with a suitable polymer matrix into the deep trench.

In useful embodiments, a distribution of particle sizes can be employed to achieve a high density of particles. In one embodiment, the particle density can preferably be at least 80% the density (e.g., volume density) of a bulk film of magnetic material. Note that hexagonal close packing of spheres having a same size has a packing factor of about 0.74 (Kepler conjecture); however, this can be exceeded for component structures using multiple-sized particles.

In other useful embodiments, synthetic polyelectrolytes can provide insulation and attach charge to the magnetic particles. The additional charge can be employed with opposite polarity electrolytes to help increase density.

It is to be understood that aspects of the present invention will be described in terms of a given illustrative architecture; however, other architectures, structures, substrate materials and process features and steps can be varied within the scope of aspects of the present invention.

It will also be understood that when an element such as a layer, region or substrate is referred to as being "on" or "over" another element, it can be directly on the other element or intervening elements can also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

The present embodiments can include a design for an integrated circuit chip, which can be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer can transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

Methods as described herein can be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

It should also be understood that material compounds will be described in terms of listed elements, e.g., CoFe. These compounds include different proportions of the elements within the compound, e.g., CoFe includes $Co_xFe_{1-x}$ where x is less than or equal to 1, etc. In addition, other elements can be included in the compound and still function in accordance with the present principles. The compounds with additional elements will be referred to herein as alloys.

Reference in the specification to "one embodiment" or "an embodiment", as well as other variations thereof, means that a particular feature, structure, characteristic, and so forth described in connection with the embodiment is included in at least one embodiment. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This can be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Referring now to the drawings in which like numerals represent the same or similar elements and initially to FIG. 1, an integrated circuit chip 10 is shown in accordance with one embodiment. The chip 10 includes a substrate 12 having multiple layers and components formed thereon or therein. The substrate 12 can include any suitable substrate structure, e.g., a bulk semiconductor, a semiconductor-on-insulator (SOI) substrate, etc. In one example, the substrate 12 can include a silicon-containing material. Illustrative examples of Si-containing materials suitable for the substrate 12 can include, but are not limited to, Si, SiGe, SiGeC, SiC, polysilicon, amorphous Si and multi-layers thereof. Although silicon is the predominantly used semiconductor material in wafer fabrication, alternative semiconductor materials can be employed, such as, but not limited to, germanium, gallium arsenide, gallium nitride, silicon germanium, cadmium telluride, zinc selenide, etc.

The substrate 12 can have any useful active or passive electrical components (not shown) formed therein or thereon. The active or passive electrical components can include transistors, diodes, capacitors, resistors, fuses, inductors, etc. One or more layers 14, 16 are formed on the substrate 12 and can include interlevel dielectric (ILD) layers, which can include contacts, metal lines and other structures.

Additional layers 20, 22, 24 can include back end of the line (BEOL) structures such as, e.g., inductor devices 26. While a BEOL inductor device 26 is depicted, embodiments of the present invention can include inductors, transformers or other components with coils or windings formed anywhere on the chip 10. The inductor or inductor device 26 includes a coil or coils 28. The coils 28 include a deposited conductor that can include a helical structure having any shape or size. The helical structure can be formed with portions in different layers 20, 22, 24. The portions can include horizontal portions (e.g., metal lines) and vertical portions (e.g., contacts or vias). The coils 28 are wound about a core region 30. The coils 28 can include any highly conductive materials, such as a metal, e.g., Cu, Ti, W, Pt, Ag, Au, etc.

In conventional inductors, the core region includes a dielectric material or a solid metal. These dielectric material cores lack energy storage capacity, and the solid metal cores are subject to eddy currents and energy loss associated with the eddy currents.

In accordance with embodiments of the present invention, the core 30 is filled with a plurality of particles 32. The particles 32 can include different shapes although spheres are preferable. The particles 32 can include a same size although a plurality of different sizes is preferable. The plurality of particles 32 can include a magnetic material or paramagnetic material (e.g., include magnetic properties). In particularly useful embodiments, magnetic materials are employed for the particles 32. The materials for the particles 32 can include Fe, Co, Ni, Mn or combinations (e.g., CoFe, FeNi, etc.) or alloys of these materials. Soft magnetic materials are preferably employed as such materials are easily magnetized and demagnetized, e.g., soft magnetic material have an intrinsic coercivity less than 10,000 $Am^{-1}$.

The plurality of particles 32 can be dispersed within a matrix material 34. The matrix material 34 can include a polymer, such as polyimide, although other dielectric materials may be employed. The polymer of the matrix material 34 can include a screen printable polymer, and the particles 32 can be printed using screen printing to control their size and shape. The particles 32 improve energy storage (magnetic material) and minimize power loss (i.e., eddy currents are thwarted).

In some embodiments, a plurality of layers can be employed for 30 each having different densities or different sized particles 32 may be employed. The plurality of particles 32 can be dispersed in a pattern or configuration within the matrix material 34.

Screen-printing is the process of transferring an ink through a patterned woven mesh screen or stencil. The matrix 34 and particles 32 can both be formed using screen printing. The screen printing process can make a plurality of passes and form different components with each pass, e.g., alternating layers of matrix materials 34, with or without different sized particles 32. In one embodiment, the particles 32 are formed in a deep trench formed, by using, e.g., a deep RIE (similar to through silicon via (TSV) etching) to form deep trenches in BEOL dielectric materials to form the core trench. Next, instead of sputtering or electroplating, e.g., Co/Fe alloys (which are subject to eddy current loss), fine particles of, e.g., Co or Co—Fe alloys can be screen printed in the core trench with intermittent layers of the matrix 34 formed or the core trench can finally be covered with a suitable polymer matrix over or into the deep core trench to form core 30. In another embodiment, the core fill or matrix 34 can include a gel, slurry or resist with particles 32 intermixed, which can be applied to the device and cured within the core trench.

In one embodiment, the core volume is filled by at least 80% volume of metal particles 32 although improvements can be gained by lower density fills. This high density fill can be achieved using multiple sized particles, charged particles of different sizes and polarities, etc. Average particle size for particles 32 can range from between about 10 nm to about 500 nm, although other sizes are contemplated.

In one embodiment, the particles 32 of magnetic materials are coated with a polymer. Example polymer coating materials can include poly(methyl methacrylate) (PMMA) poly (ethyl methacrylate), poly(ethylene-altmaleicanhydride) (PEMA), polyether amine (PEI), poly(methacrylic acid) (PMAA), poly(4-styrene sulfonic acid-co-maleic acid) (PSSMA), polyacrylic acid, poly thiol, mixtures and co-polymers of these or other materials.

Figure 2:
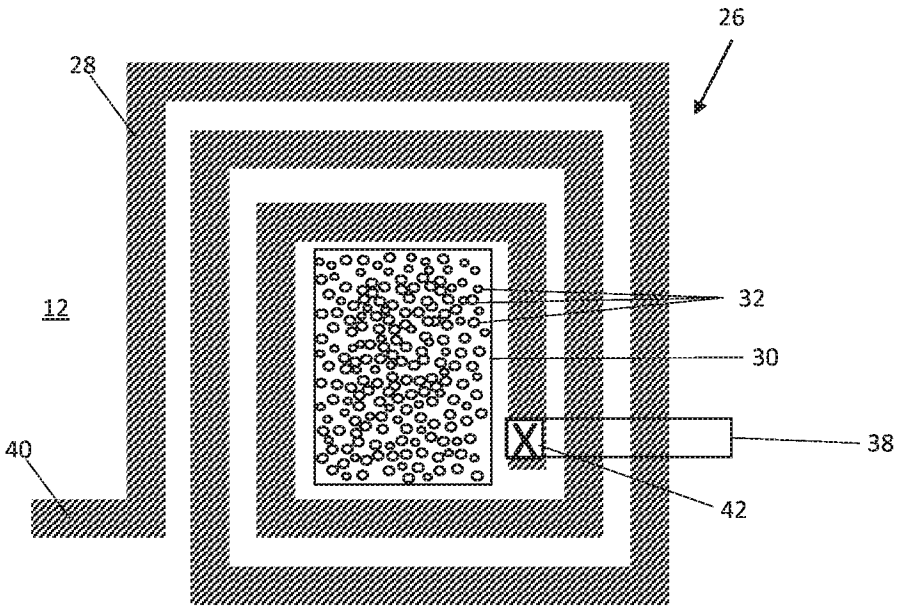
FIG. 2 is a top view showing an inductor device, with dielectric material being transparent, the inductor device having a particulate core in accordance with an embodiment of the present invention.

Referring to FIG. 2, a top view of an illustrative inductor device 26 is shown in accordance with one embodiment. The inductor device 26 includes a spiral coil 28 that winds about the core 30. The spiral coil 28 can take on a plurality of different configurations including two dimensional layouts (planar inductors) or three dimensional structures where the coils are distributed in a number of layer stacks, e.g., a conical spiral, a pyramidal spiral, etc. The core 30 can extend deeply into the depth of the coil 28 to occupy its core. While the core 30 is depicted as rectangular, the core 30 can have any shape, e.g., circular, oval, polygonal, etc. Note the inductor device 26 can have windings in either clockwise or counterclockwise directions.

The inductor device 26 includes an input and output lines or terminals 38, 40. The input/output terminal 38 includes a via 42 that carries the connection to a different layer in the device structure to avoid contact with the other lines of coil 28. The coil 28 is encapsulated in dielectric and spaces/gaps between portions of the coil 28 are filled with dielectric. The dielectric is not depicted for visualization purposes and can be air or vacuum.

Figure 3:
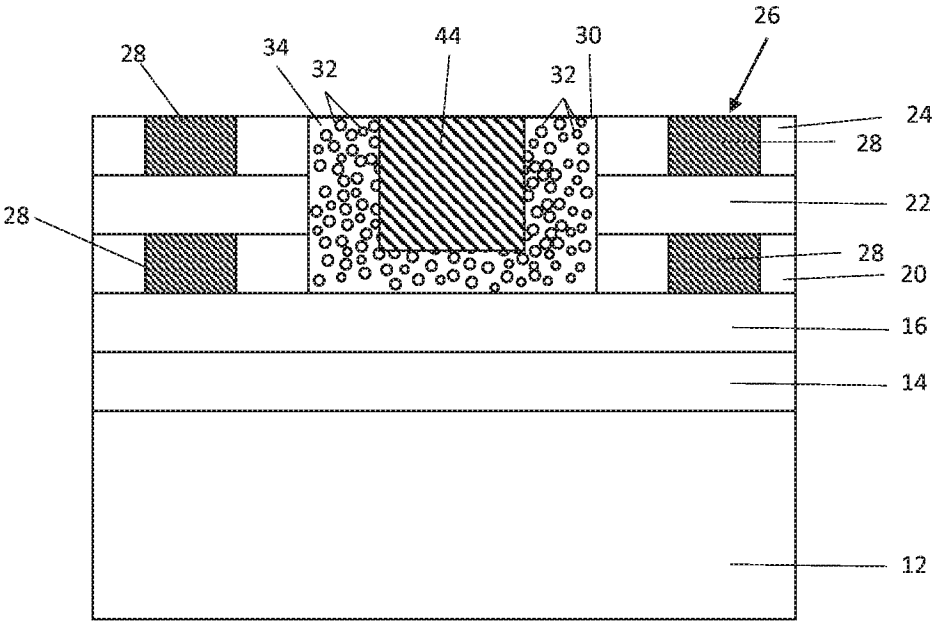
FIG. 3 is a cross-sectional view showing an inductor device having a particulate core with a solid core disposed within the particulate core in accordance with an embodiment of the present invention.

Referring to FIG. 3, in another embodiment, the core can be modified to include a metal core 44 with the magnetic particle core 30. The core 30 can be subjected to a patterned etch (e.g., using lithographic techniques) to open up a center or other region in the core by etching (e.g., RIE). Then, a deposition process (sputtering, evaporation, etc.) may be employed to deposit a metal, e.g., a magnetic or paramagnetic material, such as Fe, Co, Ni, Mn, etc. or combinations of these. The core 30 and the core 44 can be combined to make adjustments between eddy current loss and stored energy.

In useful embodiments, the sizes of the core 30 and core 44 can be determined to provide the desired operational characteristics. In addition, the materials can be selected for the particle 32 and the core 44 to provide the desired operational characteristics. It should be understood that in other embodiments the core 44 may be formed first followed by the core 30 (e.g., the core 30 could be inside core 44). More complex core structures may also be employed (e.g., stacked cores 44 and 30, multiple concentric cores of cores 44 and 30, vertical or horizontal bars of cores 44 and 30, etc.

Figure 4:
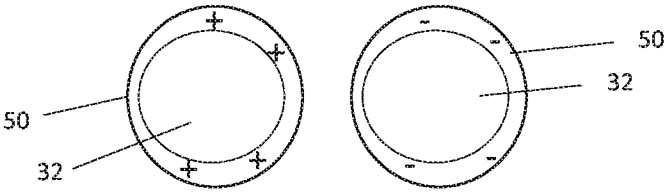
FIG. 4 is a cross-sectional view showing particles of an inductor core having a polymer coating with charge in accordance with an embodiment of the present invention.

Referring to FIG. 4, the particles 32 can be coated with dielectric materials that can carry an electrical charge. In one embodiment, the particles 32 can be coated with a coating 50 of, e.g., synthetic or natural polyelectrolytes, such as, e.g., poly(sodium styrene sulfonate) (PSS) (poly-cation), polyacrylic acid (PAA) (poly-cation), polystyrene sulfonic acid (PSSA) (poly-anion), etc.

The polyelectrolytes provide insulation and can attach charge to the particles 32. The particles 32 can be of a same size and printed with different materials for each print screen pass. The particles 32 can be formed with opposite polarities using, e.g., poly-anion or poly-cation polymers. The different sized particles can attach to one another to provide a higher particle density (e.g., at least 80% of the density of a bulk (solid) film).

Figure 5:
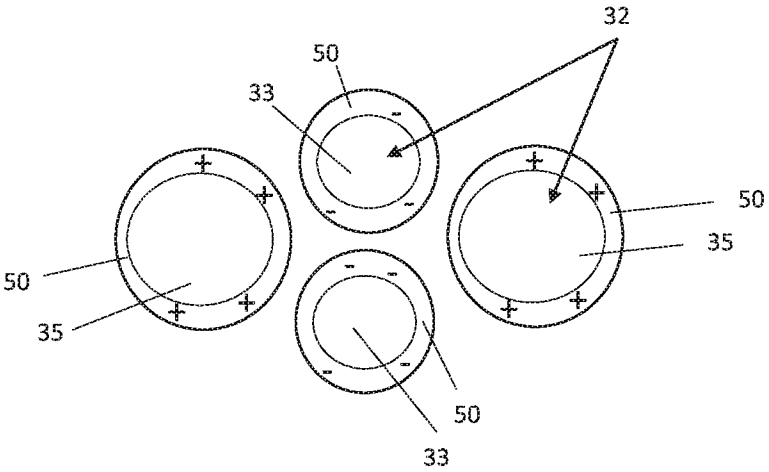
FIG. 5 is a cross-sectional view showing particles of an inductor core having different sizes and having a polymer coating with charge in accordance with an embodiment of the present invention.

Referring to FIG. 5, the particles 32 can be coated with a coating 50 of dielectric materials that can carry an electrical charge. In one embodiment, a distribution of particle sizes is provided to achieve good density. Different sized particles 33, 35 can be formed with opposite polarities using poly-anion or poly-cation polymers. The different sized particles 33, 35 will attach to one another to provide a higher particle density (e.g., at least 80% of the density of a bulk (solid) film).

Figure 6:
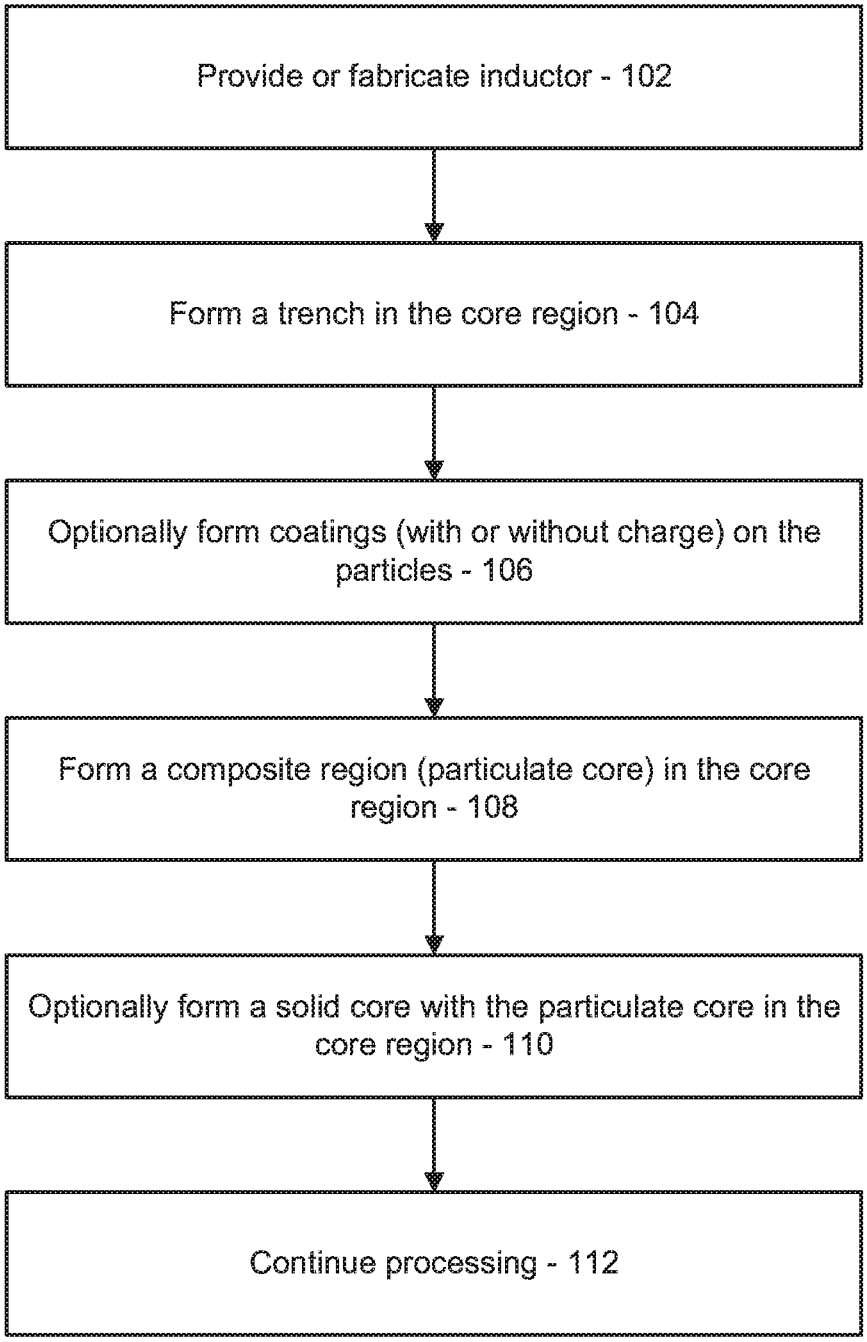
FIG. 6 is a block/flow diagram showing method for fabricating an inductor device in accordance with embodiments of the present invention.

Referring to FIG. 6, methods for forming an inductor device are shown in accordance with the present embodiments. In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

In block 102, a chip or other integrated circuit device having an inductor or an inductor-like coil is provided for adjustment of its operating properties. The coil may be fabricated already or the coil and the core, as will be described, may be formed step-wise layer-by-layer with portions of the core being stacked as other layers around it are concurrently formed. In one embodiment, the coil is formed first and then a trench as described in the next step is formed.

In block 104, a trench is formed within a central core region of a conductive coil. The conductor coil can be formed with a dielectric material, such as BEOL dielectric materials. The coil can have any useful shape that winds about the core. The coil can be two or three dimensional. The trench can be formed in accordance with a lithographic pattern (e.g., using a resist). The trench can be etched by a RIE process, such as a deep RIE process similar to a through silicon via (TSR) process.

In block 106, in one embodiment, the particles may be pre-formed with polymer coatings thereon. The preformed coated particles can be delivered during a screen printing process as a combination of polymer (matrix) and coated particles. The polymer encapsulation process can be employed to coat the particles (e.g., hydrolysis/precipitation methods can be employed). In another embodiment, the coated particles can be deposited in the areas of interest directly by a screen printing process, where the coating particles are mixed with suitable polymeric compounds thus forming a paste of suitable viscosity and the paste is applied to the area of interest through a stencil that defines the core regions of the inductor.

The coatings can include electrical charge by employing, e.g., polyelectrolytic materials. For example, different sized particles can have different charge to enable higher density packing. Higher density packing is preferred (e.g., greater than 80% particles by volume in the core).

In block 108, a composite region is formed within the trench. The composite region can include a polymer matrix having a plurality of particles with magnetic properties dispersed therein within the central core region. The composite region reduces eddy current loss and increases energy storage. In one embodiment, the composite region is formed by screen printing. The composite region can include a particle density of at least 80% by volume in the central core region, although other densities may be employed.

In block 110, in one embodiment, a solid core can be formed within the plurality of particles (or can be formed before the matrix with the plurality of particles is introduced) dispersed within the central core region. An etch process can be employed to form another trench within the composite region (particulate core). Then, a deposition process (e.g., sputtering, evaporation, etc.) can be employed to form a layer having magnetic properties in the trench. A planarization process, such as chemical mechanical polishing (CMP) can be employed to polish a top surface to confine the layer having magnetic properties to the trench. The size and shape of the trench can be employed to adjust the properties of the device to modify the amount of eddy current loss and/or the amount of energy storage. The size and shape of the trench can be determined by the patterning and etching processes.

In another embodiment, a solid layer can be formed by a deposition process (e.g., sputtering, evaporation, etc.) employed to form the layer having magnetic properties in the trench. A planarization process, such as chemical mechanical polishing (CMP) can be employed to polish a top surface to confine the layer having magnetic properties to the trench. A core having the plurality of particles is introduced where the particles are dispersed within a central core region.

In block 112, processing can continue with the formation of additional BEOL structures or other structures. These structures can include additional dielectric layers, metal connections, packaging structures, etc.

Once formed, the device can be activated or its performance changed by modulating or step-wise changing a voltage on the piezoelectric element. The piezoelectric element flexes and can alter the vacuum gap between electrodes. It should be understood that other variations are contemplated, for example, two opposing piezoelectric elements may have terminals vacuum gapped and both may be deflected to alter the gap distance between them.

Having described preferred embodiments of inductors in BEOL with particulate magnetic cores (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method for forming an inductor device, comprising:

forming a conductive coil within a dielectric material;

forming a trench within a central core region of the conductive coil; and forming a composite region within the trench, the composite region including a polymer matrix having a plurality of particles with magnetic properties dispersed in the polymer matrix to reduce eddy current loss and increase energy storage, each of the plurality of particles having an electrically charged coating, the plurality of particles including different sizes with electrical charges corresponding to particle size, wherein the central core region has a plurality of particle densities of the particles with magnetic properties.

2. The method as recited in claim 1, wherein forming the composite region includes screen printing the composite region.

3. The method as recited in claim 1, further comprising an average particle density of particles with the magnetic properties of at least 80% by volume in the central core region.

4. The method as recited in claim 1, further comprising forming a solid core within the plurality of particles dispersed within the central core region.

5. The method as recited in claim 1, wherein the plurality of particles are coated with a polyelectrolyte.

6. The method as recited in claim 1, wherein the central core region has a plurality of layers, each of the layers having a different particle density of particles with the magnetic properties.

7. A method for forming an inductor device, comprising:

forming a trench within a central core region of a conductive coil; and forming a composite region within the trench, the composite region including a polymer matrix having a plurality of particles with magnetic properties dispersed in the polymer matrix to reduce eddy current loss and increase energy storage, each of the plurality of particles having an electrically charged coating, the plurality of particles including different sizes with electrical charges corresponding to particle size.

8. The method as recited in claim 7, wherein forming the composite region includes screen printing the composite region.

9. The method as recited in claim 7, wherein the plurality of particles with magnetic properties have a plurality of particle densities.

10. The method as recited in claim 9, wherein the particle density of the plurality particles with magnetic properties have an average particle density of at least 80% by volume in the central core region.

11. The method as recited in claim 7, further comprising forming a solid core within the plurality of particles dispersed within the central core region.

12. The method as recited in claim 7, wherein the plurality of particles with magnetic properties are coated with a polyelectrolyte.

13. The method as recited in claim 7, wherein the central core region has a plurality of layers, each of the layers having a different particle density of the plurality of particles with magnetic properties.

14. The method as recited in claim 7, wherein the conductive coil is formed within a dielectric material.

15. A method for forming an inductor device, comprising:

forming a conductive coil within a dielectric material;

forming a trench within a central core region of the conductive coil;

dispersing, in a polymer matrix, a plurality of particles with magnetic properties to reduce eddy current loss and increase energy storage, each of the plurality of particles having an electrically charged coating, the plurality of particles including different sizes with electrical charges corresponding to particle size; and forming a composite region by depositing the polymer matrix within the trench.

16. The method as recited in claim 15, wherein forming the composite region includes screen printing the composite region.

17. The method as recited in claim 15, wherein the plurality of particles with magnetic properties have a plurality of particle densities.

18. The method as recited in claim 17, wherein the particle density of the plurality particles with magnetic properties have an average particle density of at least 80% by volume in the central core region.

19. The method as recited in claim 15, wherein the plurality of particles with magnetic properties are coated with a polyelectrolyte.

20. The method as recited in claim 15, wherein the central core region has a plurality of layers, each of the layers having a different particle density of the plurality of particles with magnetic properties.

* * * * *